US010843259B2

(12) United States Patent
Franz et al.

(10) Patent No.: US 10,843,259 B2
(45) Date of Patent: Nov. 24, 2020

(54) CASTING METHOD

(71) Applicant: ALD VACUUM TECHNOLOGIES GMBH, Hanau (DE)

(72) Inventors: Henrik Franz, Freigericht-Horbach (DE); Sergejs Spitans, Hanau (DE); Ulrich Betz, Hasselroth (DE); Egon Bauer, Bessenbach (DE); Markus Holz, Bruchköbel (DE)

(73) Assignee: ALD VACUUM TECHNOLOGIES GMBH, Hanau (DE)

( * ) Notice: Subject to any disclaimer, the term of this patent is extended or adjusted under 35 U.S.C. 154(b) by 0 days.

(21) Appl. No.: 16/478,174

(22) PCT Filed: Jan. 17, 2018

(86) PCT No.: PCT/EP2018/051056

§ 371 (c)(1),
(2) Date: Jul. 16, 2019

(87) PCT Pub. No.: WO2018/134219

PCT Pub. Date: Jul. 26, 2018

(65) Prior Publication Data

US 2019/0366427 A1 Dec. 5, 2019

(30) Foreign Application Priority Data

Jan. 17, 2017 (DE) ..... 10 2017 100 836

(51) Int. Cl.
*B22D 39/00* (2006.01)
*B22D 13/02* (2006.01)
(Continued)

(52) U.S. Cl.
CPC ..... *B22D 39/003* (2013.01); *B22D 13/026* (2013.01); *B22D 13/107* (2013.01);
(Continued)

(58) Field of Classification Search
CPC .. B22D 39/009; B22D 39/003; B22D 13/026; B22D 13/107; B22D 21/022; B22D 21/025; B22D 27/003; B22D 27/15
See application file for complete search history.

(56) References Cited

U.S. PATENT DOCUMENTS 2,686,864 A 8/1954 Wroughton et al.
3,023,091 A * 2/1962 Smith ..... C30B 13/04 23/296
(Continued)

FOREIGN PATENT DOCUMENTS

DE 422004 A 11/1925
DE 1224049 A 9/1966
(Continued)

OTHER PUBLICATIONS

English Machine Translation of Matsuo JP2012040590 (Year: 2012).*

*Primary Examiner* — Kevin P Kerns
*Assistant Examiner* — Steven S Ha
(74) *Attorney, Agent, or Firm* — Hudak, Schunk & Farine Co. LPA

(57) ABSTRACT

A method for producing cast items in a casting method, wherein a charge of a conductive material is introduced into the sphere of influence of at least one alternating electromagnetic field, so that the charge is kept in a levitating state. The melt is poured into moulds in order to produce turbine blades, prostheses or turbocharger impellers.

25 Claims, 6 Drawing Sheets

(51) Int. Cl.

| | |
|---|---|
| ***B22D 13/10*** | (2006.01) |
| ***B22D 21/02*** | (2006.01) |
| ***B22D 27/00*** | (2006.01) |
| ***B22D 27/15*** | (2006.01) |

(52) U.S. Cl.
CPC ..... *B22D 21/022* (2013.01); *B22D 21/025* (2013.01); *B22D 27/003* (2013.01); *B22D 27/15* (2013.01)

(56) References Cited

U.S. PATENT DOCUMENTS

| | | | |
|---|---|---|---|
| 4,578,552 | A | 3/1986 | Mortimer |
| 5,416,793 | A | 5/1995 | Hugo et al. |

FOREIGN PATENT DOCUMENTS

| | | | |
|---|---|---|---|
| DE | 1240825 | A | 5/1967 |
| DE | 8703318 | U1 | 5/1987 |
| DE | 4228402 | A1 | 3/1994 |
| DE | 69031479 | T2 | 4/1998 |
| DE | 100 47 397 | A1 | 5/2002 |
| DE | 69617103 | T2 | 6/2002 |
| EP | 0747648 | A1 | 12/1996 |
| EP | 0395286 | B1 | 9/1997 |
| JP | 3075302 | B2 | 8/2000 |
| JP | 2010284694 | A | 12/2010 |
| JP | 2012040590 | A | 3/2012 |
| JP | 2012166207 | A | 9/2012 |
| JP | 2012206124 | A | 10/2012 |

* cited by examiner

CASTING METHOD

FIELD OF THE INVENTION

This invention relates to a casting method for producing cast items. The method is a levitation melting method in which the melt does not come into contact with the material of a crucible, thus making it possible to avoid contamination with the crucible material or by a reaction between the melt and the crucible material.

Avoiding this kind of contamination is important especially in the case of metals and alloys having high melting points. Such metals are for example titanium, zirconium, vanadium, tantalum, tungsten, hafnium, niobium, rhenium and molybdenum. However, it is also important in the case of other metals and alloys such as nickel, iron and aluminium.

BACKGROUND OF THE INVENTION

Levitation melting methods are known from the prior art. Thus, a melting method in which the conductive melt material is heated by means of inductive currents and is simultaneously made to float freely by means of electrodynamic effects is already disclosed in DE 422 004 A. The document also describes a casting method in which the molten material, facilitated by a magnet, is pressed into a mould (electrodynamics die-casting). The method can be carried out in a vacuum. However, this document does not teach that a molten charge is sufficient for filling the mould.

U.S. Pat. No. 2,686,864 A also describes a method in which a conductive melt material is made to adopt a levitating state, for example in a vacuum, under the influence of one or more coils, without the use of a crucible. In one embodiment, two coaxial coils are used in order to stabilize the levitating material. Once molten, the material is allowed to drop into a mould, or is poured off. The method described in that document is adequate for keeping suspended a quantity of aluminium weighing 60 g. The molten metal is withdrawn by reducing the field strength so that the melt escapes downward through the conically narrowing coil. If the field strength is reduced very rapidly, the metal falls out of the device in the molten state. It is already known that the "weak spot" of coil arrangements of this kind is at the centre of the coils, which limits the quantity of material that can be melted in this manner.

U.S. Pat. No. 4,578,552 A also discloses a device and a method for levitation melting. The same coils are used both for heating and also for holding the melt, and in that context the frequency of the applied alternating current is varied in order to regulate the heating power, while the strength of the current is kept constant.

The particular advantages of levitation melting lie in avoiding contamination of the melt with a crucible material or other materials which, in other methods, are in contact with the melt. The levitating melts are in contact only with the surrounding atmosphere, which can for example be a vacuum or a protective gas. Eliminating the risk of a chemical reaction with a crucible material means that the melt can be heated to very high temperatures. Furthermore, the waste in terms of contaminated material is reduced in particular in comparison with melting by the cold crucible method. And yet, levitation melting has not become established in practice. This is because levitation melting allows only a relatively small quantity of molten material to be kept suspended (cf. DE 696 17 103 T2, page 2, paragraph 1).

For that reason, use has been made, in part, of a semi-levitating method in which molten material is not kept suspended but is oriented according to a similar principle, while the material rests on a platform instead of levitating. Such a method is described in DE 696 17 103 T2 and DE 690 31 479 T2. However, material melted in this manner proves difficult to pour into a mould. Furthermore, this process produces a significant proportion of unusable material which has been contaminated by contact with the platform. DE 690 31 479 T2 uses a platform having a circular opening that is closed with identical material. Once fully molten, the melt flows out of the melting region through the opening.

The drawbacks of the methods known from the prior art can be summarized as follows. Full-levitation melting methods can be used only with small quantities of material, and so industrial application has not been successful hitherto. Semi-levitating melting methods have the drawback of it being necessary to discard that proportion of the material used which has come into contact with the platform. Also, pouring into moulds is difficult. As a result, it has hitherto not been possible to carry out full-levitation melting methods for the production of cast items on an industrial scale.

SUMMARY OF THE INVENTION

The present invention therefore has the object of providing a method which permits the industrial use of levitation melting while avoiding the material loss typical of the semi-levitating melting method and cold crucible method and achieving all of the advantages of levitation melting technology. In particular, the method should permit high throughput and should be able, without the use of a supporting platform, to melt a sufficient quantity of material to permit industrial production of very high-quality cast items.

The object is achieved with the method according to the invention. The invention provides a method for producing cast items of a conductive material, comprising the following steps:

introducing a charge of the conductive material into the sphere of influence of at least one alternating electromagnetic field (melting region), so that the charge is kept in a levitating state, melting the charge, positioning a mould in a filling region below the levitating charge, pouring the entire charge into the mould, removing the solidified cast item from the mould, wherein the volume of the molten charge is sufficient to fill the mould to an adequate degree for the production of a cast item (the "fill volume"). Once the mould has been filled, it is allowed to cool or is cooled using a coolant so that the material solidifies in the mould. Then, the cast item can be removed from the mould. Pouring can consist in allowing the charge to fall, in particular by switching off the alternating electromagnetic field, or pouring can be slowed using an alternating electromagnetic field, for example by using a coil.

DESCRIPTION OF THE INVENTION

In one embodiment, the method comprises the step of removing the filled mould from the filling region after pouring but prior to removal of the solidified cast item. This embodiment is employed to particular advantage when using lost moulds, since it frees up the filling region for another lost mould. In another embodiment, in particular when using a permanent mould, the removal of the cast item can take place in the filling region.

The solidified cast item can be removed in various ways. In one embodiment, the mould is destroyed when removing the cast item. This is referred to as the "lost mould" method. In another embodiment, the mould can be made as a permanent mould, in particular as a permanent die. Permanent dies are preferably made of a metallic material. They are suitable for simpler components.

A permanent mould preferably has two or more mould elements that can be separated from one another in order to remove the cast item. One or more ejectors can be used for de-moulding from permanent moulds.

According to the invention, a "conductive material" is to be understood as a material having a suitable conductivity for inductively heating and levitating the material.

According to the invention, a "levitating state" is to be understood as a state of complete levitation so that the charge being processed has no contact whatsoever with a crucible or a platform or the like.

A "fill volume" of a mould is to be understood as a volume which fills the mould to a degree that is sufficient for the production of one or more complete cast items that are to be formed using the mould. This need not necessarily correspond to complete filling of the mould, nor need it correspond to a minimum volume necessary for the production of a cast item. What is decisive is that it is not necessary to fill the mould beyond the fill volume. In particular, a mould can, in the context of this invention, have channels or filling sections which need not be filled in order to produce complete cast items, but rather which serve merely to pour the melt into the mould or to distribute it therein. According to the invention, the mould is in particular not filled beyond the volume of the molten charge.

The moulds used according to the invention have cavities which correspond to the shape of the cast items to be produced. It is also possible, within the context of this invention, to use moulds which have more than one such cavity and which are therefore suitable for the simultaneous production of multiple cast items. In one embodiment, the moulds used according to the invention have exactly one cavity for the production of exactly one cast item. In one embodiment, the mould has a filling section of greater diameter than the cavity of the mould that is to be filled. A filling section of this kind can in particular be designed in the form of a funnel. It serves to facilitate the entry of the molten charge into the mould.

The mould is preferably made of a ceramic, in particular oxide-ceramic, material such as in particular $Al_2O_3$, $ZrO_2$, $Y_2O_3$ or mixtures thereof. This mould material has proved itself in practice and is advantageous in particular for lost moulds. Permanent moulds, which may also be used according to the invention, can be made of a metallic material, that is to say a metal or a metal alloy.

According to the invention, another empty mould can be moved into the filling region after the removal from the filling region of a filled mould, or entirely or partially simultaneously with the removal from the filling region of the mould filled with the charge. Alternatively, in particular in the case of permanent moulds, the cast item can be removed from the mould while still in the filling region, without it being necessary for the mould to be removed from the filling region. Furthermore, after pouring of the charge a further charge of the conductive material can be introduced into the sphere of influence of the alternating electromagnetic field. The further charge can identically be melted and poured into the further mould. This procedure can be repeated as often as desired, especially since it requires no crucible which would be subject to wear. The method according to the invention can be carried out at such a rhythm that every charge of conductive material is assigned to exactly one mould. The mould is adequately filled with one charge and can be removed from the filling region in order to make way for the next mould for receiving the next charge. This permits a particularly efficient process which allows high throughput even with the relatively limited capacity of the levitation melting method.

In one embodiment, the mould is preheated prior to filling. A preheated mould has the advantage that the molten charge does not immediately solidify on contact with the mould. Especially in the case of fine cavities to be filled, as occur for example in the context of impellers for turbochargers, it is expedient to heat the mould to a temperature which allows the molten charge to spread into the fine cavities of the mould before the material solidifies. It has proven advantageous to preheat the moulds to temperatures in the range from 400 to 1100° C., in particular 500 to 800° C., before the mould is filled with the molten charge. A temperature that is too low cannot, under certain circumstances, prevent solidification. A temperature that is too high increases the risk of undesired reactions between the material and the mould. The invention also encompasses embodiments in which the mould is not preheated. Embodiments of this kind can in particular be carried out if the molten charge can be superheated to a sufficiently high temperature and therefore does not solidify immediately even when the mould is not preheated. A person skilled in the art will have to weigh up, on a case-by-case basis, whether and to what temperature the mould is to be preheated, in which context the following all play a role: the size of the mould and its cavities, the melting temperature of the material, the melting point thereof and the influence of temperature on the viscosity, the material of the mould and the reactivity of the material.

In order to speed up the distribution of the melt in the mould, it is possible, during filling, for the mould to be rotated about a vertical axis, in particular a vertical axis of symmetry. Thus, the melt in the mould is flung, as it were, into the cavities. Especially in the case of melt material whose viscosity increases rapidly as the temperature drops, it is important to get this material into the cavities of the mould quickly so that solidification does not set in before the mould is adequately filled. It must be taken into account that the molten charge starts to cool as soon as it is poured. A material in which viscosity is very dependent on temperature is titanium and titanium alloys, in particular TiAl, and so the mould should be rotated especially when the conductive material is titanium or a titanium alloy. In addition to the more rapid distribution of the molten charge in the mould, the rotation also avoids turbulence which has an extremely negative effect on the quality of the cast items.

It has proven advantageous for the rotation of the mould to be carried out with a rotational speed of 10 to 1000, in particular 100 to 500 or 150 to 350, revolutions per minute. The rotational speed to be chosen is dependent on the viscosity behaviour of the molten charge and the internal shape of the mould. The faster the viscosity of the material increases on cooling, the faster it must be flung into the cavities of the mould.

Preferably, according to the invention, both melting of the conductive material and filling of the mould are carried out under vacuum or under a protective gas. Preferred protective gases are, depending on the material to be melted, nitrogen, one of the noble gases or mixtures thereof. Use is particularly preferably made of argon or helium. The use of a protective gas or a vacuum serves to avoid undesired reactions between the material and components of the atmosphere, in particular oxygen. Preferably, melting and/or filling of the mould are carried out under vacuum, in particular at a pressure of at most 1000 Pa.

In one advantageous embodiment of the method according to the invention, at the moment of filling, the mould is moved in translation parallel to the direction of pouring of the charge, in particular in the direction of pouring. In other words, the mould, triggered by the pouring procedure, is moved upward or downward. This controls, i.e. accelerates or slows, the filling rate of the mould. This measure of translation can be carried out as an alternative or in addition to the above-described rotation. Both measures contribute to optimal filling in the sense of the mould being filled as completely and rapidly as possible while at the same time having low turbulence, so that the quality of the cast items obtained is improved. Translation in the pouring direction takes place at a speed that is less than the speed with which the molten charge falls. The acceleration of the mould in the pouring direction should be less than the acceleration of the charge as it falls. Furthermore, the use of translation, either alone or in addition to rotation, avoids the molten charge spattering or overflowing, which would otherwise be a risk owing to the rapid and complete filling of the mould in one casting operation.

It has proven adequate to carry out the translation over a distance of at most 4 m, in particular at most 3 m, at most 2 m and particularly preferably at most 1 m, starting from the starting position of the mould at the moment of pouring. This distance is sufficient to achieve the advantages of the translational movement on the quality of the produced cast items, without the required apparatus being excessively enlarged. The translation is preferably stopped when the entire charge has entered the mould.

In particular, the rotational and/or translational movement is triggered by the pouring of the charge. To that end, it is possible to provide sensors which detect pouring and transmit a signal to a drive unit which triggers rotation and/or translation at the mould. Suitable sensors can for example detect a change in or extinction of the alternating electromagnetic field, or the presence of the molten charge in a transition region between a melting region and the mould (for example by means of light gates). A great many other sensors are also conceivable for triggering a corresponding signal.

In one preferred embodiment, the conductive material used according to the invention has at least one high-melting-point metal from the following group: titanium, zirconium, vanadium, tantalum, tungsten, hafnium, niobium, rhenium, molybdenum. As an alternative, it is also possible to use a metal having a lower melting point, such as nickel, iron or aluminium. The conductive material used can also be a mixture or alloy having one or more of the above-mentioned metals. Preferably, the metal has a fraction of at least 50 wt. %, in particular at least 60 wt. % or at least 70 wt. %, of the conductive material. It has been found that these metals benefit particularly from the advantages of the present invention. In one particularly preferred embodiment, the conductive material is titanium or a titanium alloy, in particular TiAl or TiAlV. These metals or alloys can be worked particularly advantageously since their viscosity is particularly dependent on temperature, and they are moreover especially reactive, in particular with regard to the materials of the mould. Since the method according to the invention combines contactless melting while levitating with extremely rapid filling of the mould, a particular advantage can be obtained especially for such metals. The method according to the invention makes it possible to produce cast items having a particularly thin oxide layer, or even none at all, from the melt reacting with the material of the mould.

In one advantageous embodiment of the invention, the conductive material is superheated, during melting, to a temperature at least 10° C., at least 20° C. or at least 30° C. above the melting point of the material. The superheating avoids the material solidifying immediately on contact with the mould, whose temperature is below the melting point. As a consequence, the charge can spread in the mould before the viscosity of the material becomes too high. An advantage of levitation melting is that it is not necessary to use a crucible which is in contact with the melt. Thus, the high material losses of the cold crucible method are avoided, as is contamination of the melt by crucible constituents. Another advantage is that the melt can be heated to relatively high temperatures since it is possible to operate in a vacuum or under a protective gas and there is no contact with reactive materials. However, most materials cannot be superheated simply to any temperature, as this runs the risk of a violent reaction with the mould. For that reason, superheating is preferably limited to at most 300° C., in particular at most 200° C. and particularly preferably at most 100° C. above the melting point of the conductive material.

According to the invention, melting is preferably carried out for a duration of 0.5 min to 20 min, in particular 1 min to 10 min. These melting times can easily be effected in the levitation melting method since very efficient introduction of heat into the charge is possible and, owing to the induced eddy currents, a very good temperature distribution occurs within a very short time. Once completely melted, the molten charge is poured into the mould. Pouring can consist in allowing the molten charge to drop, or can be controlled by means of electromagnetic influence, for example using a (further) coil suitable for this purpose. The filled mould is moved away and is preferably replaced with a new, empty mould so that moulds can be filled at intervals of a few minutes. According to the invention, a charge of conductive material can preferably have masses from 50 g to 2 kg, in particular 100 g to 1 kg. In one embodiment, the mass is at least 200 g. These masses are sufficient for the production of turbine blades, turbocharger impellers or prostheses. However, any other shape is also conceivable, especially since the method makes it possible to produce even complex shapes with fine and branched cavities. The combination of a high melting point and thus low viscosity, vacuum or protective gas for avoiding reactions, rotation for the rapid distribution of the melt in the mould, translation for setting an optimal filling rate, and clocked filling of the moulds in just one filling step, result in an extremely versatile method which can be optimized depending on the material to be melted and the mould used.

Preferably, in order to bring about the levitating state of the charge, use is made of at least two electromagnetic fields of different alternating current frequency. The conventional levitation melting method uses one or more conical coils in order to generate the required electromagnetic fields. It is also possible, according to the invention, to use such a conventional levitation melting method with conical coils. However, this greatly limits the size of the charges since, in the region of the axis of symmetry, the molten charge is prevented from flowing away only by the surface tension thereof. This drawback can be avoided by using at least two electromagnetic fields of different frequency (cf. Spitans et al., Magnetohydrodynamics Vol. 51 (2015), No. 1, pp. 121-132). In the absence of a load, the magnetic fields should preferably run horizontally and in particular at right angles to one another. This makes it possible to process relatively large masses of a conductive material in a full-levitation melting method. The use of different frequencies prevents the sample rotating; a frequency difference of in each case at least 1 kHz is preferred.

In one preferred embodiment of the method, in order to concentrate the magnetic field and stabilize the charge, at least one ferromagnetic element is arranged horizontally around the region in which the charge is melted. The ferromagnetic element can be arranged in annular fashion around the melting region, wherein "annular" includes not only circular elements but also angular, in particular rectangular or polygonal, annular elements. The element can have multiple bar sections which in particular project horizontally in the direction of the melting region. The ferromagnetic element is made of a ferromagnetic material, preferably having an amplitude permeability $\mu_a>10$, more preferably $\mu_a>50$ and particularly preferably $\mu_a>100$. The amplitude permeability relates in particular to the permeability in a temperature range between 25° C. and 100° C., and at a magnetic flux density between 0 and 400 mT. The amplitude permeability is in particular at least one hundredth, in particular at least 10 hundredths or 25 hundredths of the amplitude permeability of soft-magnetic ferrite (e.g. 3C92). Suitable materials will be known to a person skilled in the art.

In one preferred embodiment, the electromagnetic fields are generated by at least two pairs of induction coils whose axes are oriented horizontally, the conductors of the coils are thus preferably respectively wound on a horizontal coil former. The coils can in each case be arranged around a bar section, projecting in the direction of the melting region, of the ferromagnetic element. The coils can have coolant-cooled conductors.

In one particularly preferred embodiment of the method, in addition a coil, in particular a conical coil, having a vertical axis of symmetry is arranged below the charge to be melted, in order to influence the pouring rate. In one preferred embodiment, this coil can generate an electromagnetic field of a third alternating current frequency (cf. Spitans et al., *Numerical and experimental investigations of a large scale electromagnetic levitation melting of metals*, Conference Paper 10th PAMIR International Conference—Fundamental and Applied MHD, Jun. 20-24, 2016, Cagliari, Italy). This coil can preferably also serve to protect the ferromagnetic element from the effects of excessive heat. To that end, a coolant can be made to flow through the conductor of this coil.

The figures show preferred embodiments. They serve merely for illustrative purposes.

Figure 1:
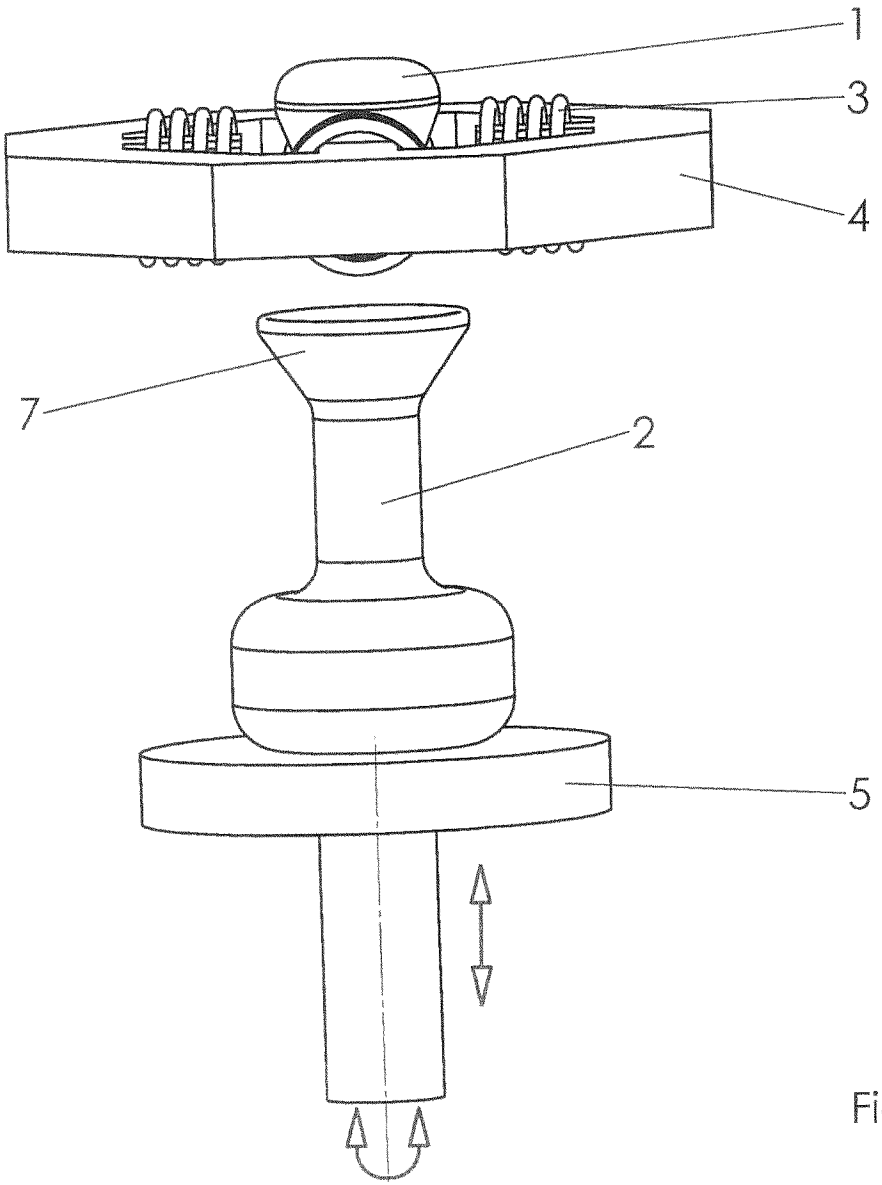
FIG. 1 is a lateral view of a casting mould below a melting region with a ferromagnetic element, coils and a charge of conductive material.

FIG. 1 shows a charge 1 of conductive material which is located in the sphere of influence of alternating electromagnetic fields (the melting region) that are generated with the aid of the coils 3. Below the charge 1 there is an empty mould 2 which is held in the filling region by a holder 5. The holder 5 is able to move the mould 2 in rotation and/or in translation, which is indicated by the arrows in the figure. A ferromagnetic element 4 is arranged around the sphere of influence of the coils 3. In the method according to the invention, the charge 1 is melted while levitating and, once molten, is poured into the mould 2. The mould 2 has a funnel-shaped filling section 7.

Figure 2:
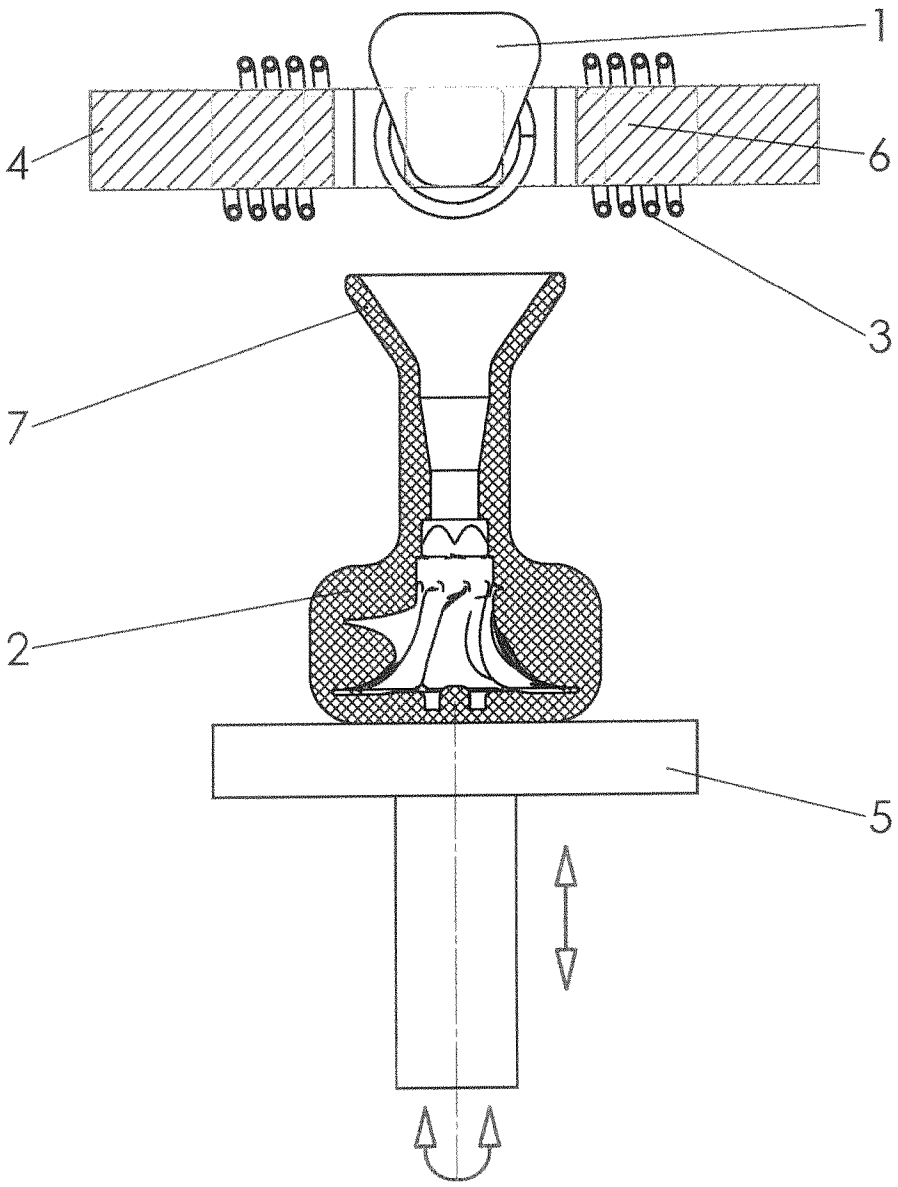
FIG. 2 is a view in section of the setup of FIG. 1.

FIG. 2 shows the same components as FIG. 1. FIG. 2 also shows the bar sections 6 which project in the direction of the melting region and around which the coils 3 are arranged. In this preferred embodiment, the bar sections 6 are parts of the ferromagnetic element 4 and form the cores of the coils 3. The axes of the coil pairs 3 are oriented horizontally and at right angles to one another, with each two opposite coils 3 forming a pair.

Figure 3:
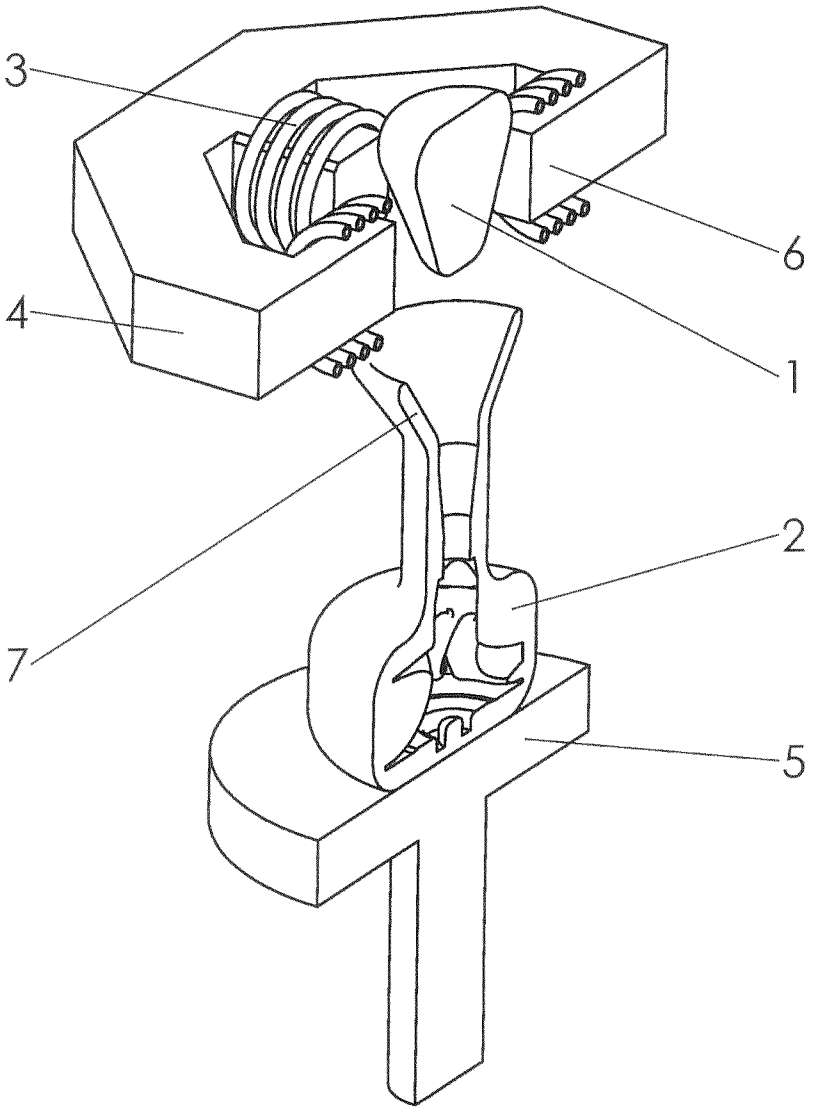
FIG. 3 is a perspective view in section of the setup of FIG. 1.

FIG. 3 shows the same components as FIGS. 1 and 2, wherein FIG. 3 clearly shows the orthogonal arrangement of the bar sections 6 and the coil axes.

Figure 4:
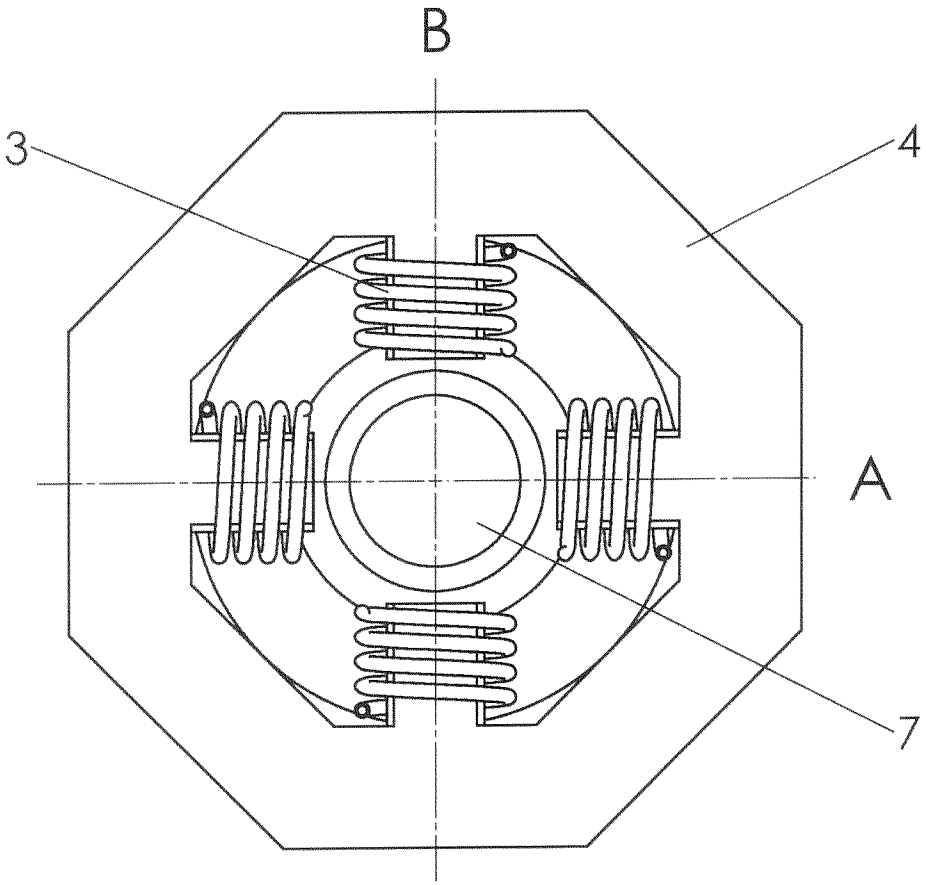
FIG. 4 is a plan view of a coil arrangement that can be used according to the invention.

FIG. 4 again shows the arrangement of the coils 3 within a ferromagnetic element 4. The ferromagnetic element 4 takes the form of an octagonal annular element. In each case two coils 3 on an axis A, B form a coil pair. The filling section 7 of a mould is visible below the coil arrangement. The coil axes A, B are arranged at right angles to one another.

Figure 5:
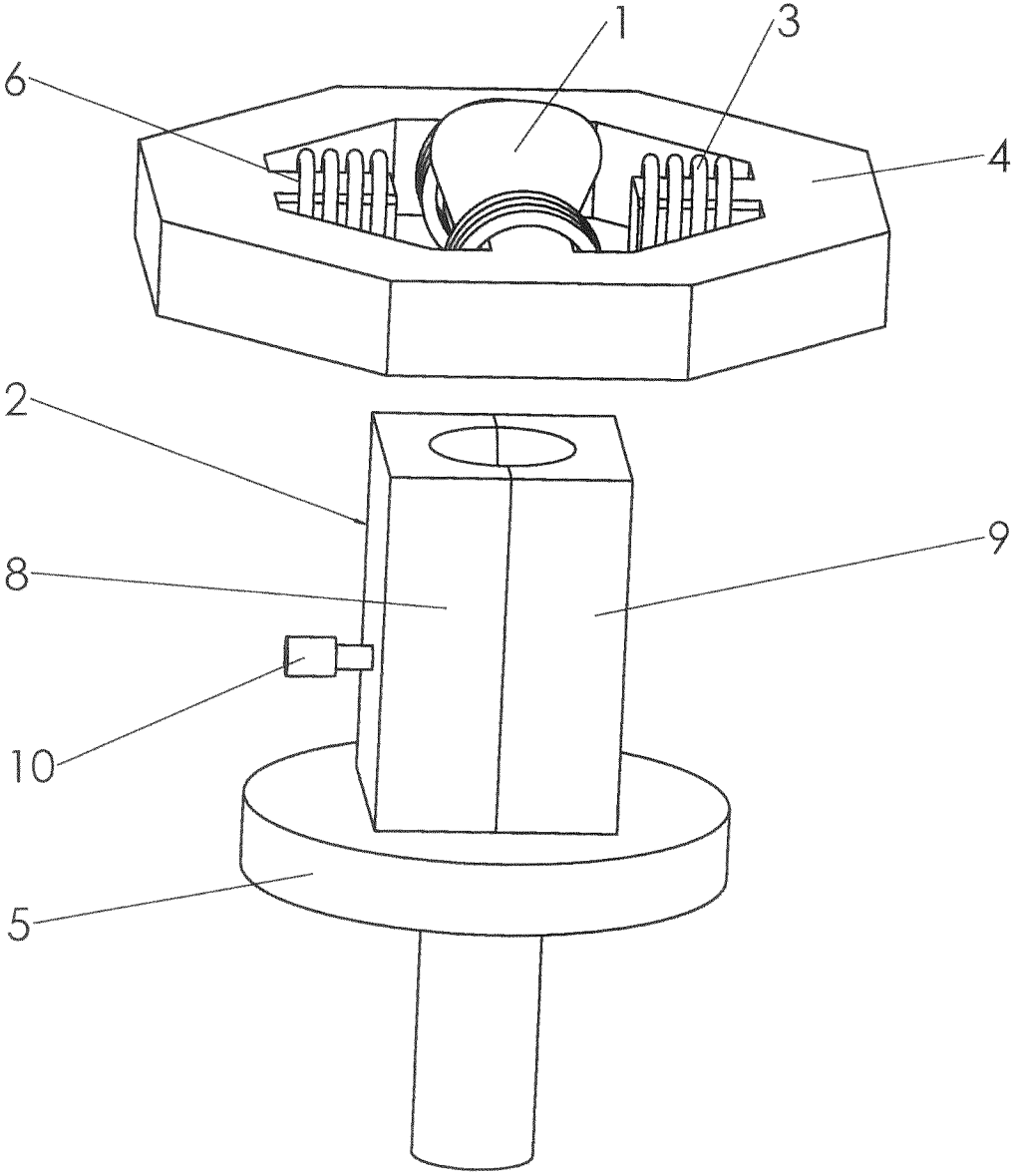
FIG. 5 is a perspective view of a permanent mould in a filling region with a charge in the melting region.

FIG. 5 shows an arrangement for carrying out a method according to the invention using a permanent mould as the mould 2. The permanent mould 2 is a permanent die having two mould elements 8, 9 which can be separated from one another for the purpose of de-moulding. An ejector 10 is guided through one of the mould elements 8 in order to support de-moulding. The permanent mould 2 is arranged on a holder 5, as was the case for the moulds in the form of lost moulds, so that the mould 2 can be made to move in rotation and/or in translation. De-moulding of the permanent mould 2 can take place in the filling region.

Figure 6:
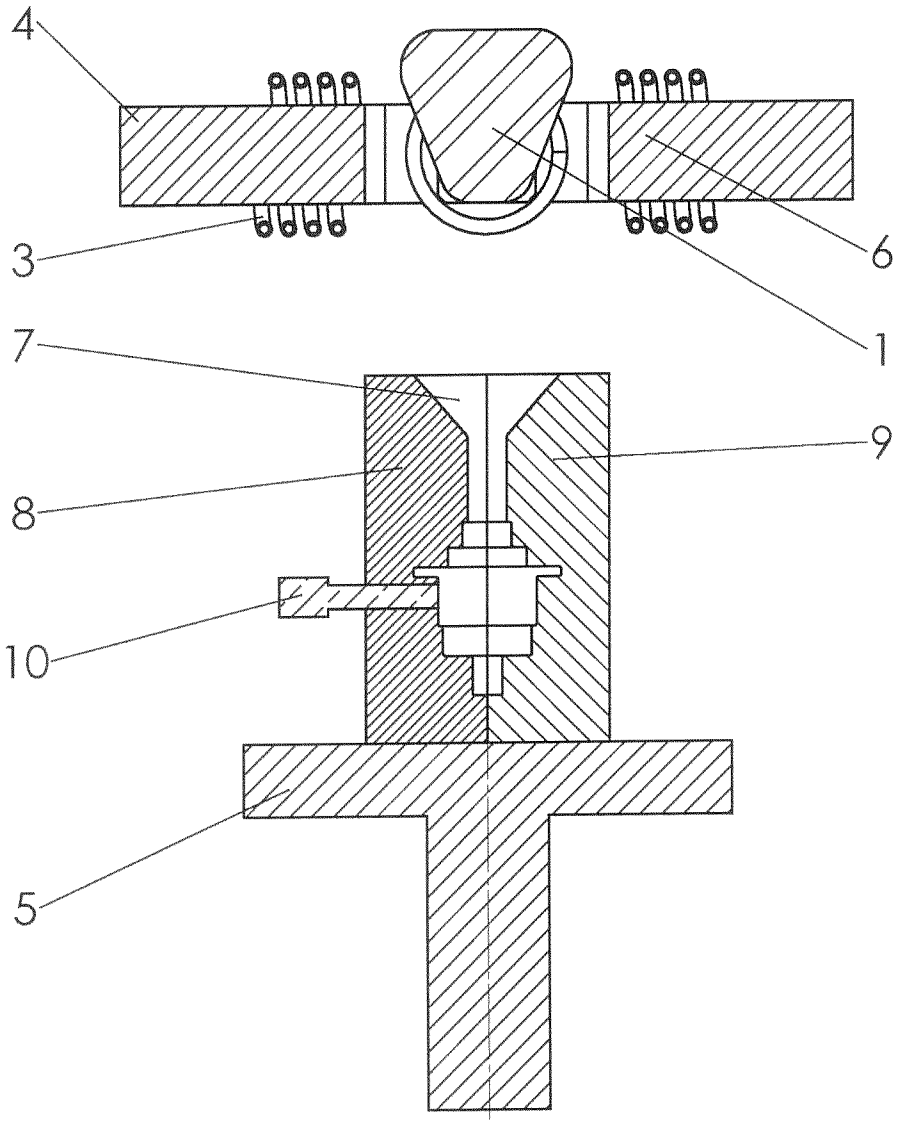
FIG. 6 is a view in section of a permanent mould in a filling region, also with a charge in the melting region.

FIG. 6 shows a view in section through an arrangement for carrying out the method according to the invention, using a permanent mould 2 having two mould elements 8, 9 and an ejector 10. The permanent mould 2 also has a funnel-shaped filling section 7.

LIST OF REFERENCE NUMERALS

1 Charge
2 Mould
3 Coil
4 Ferromagnetic element
5 Holder
6 Bar section
7 Filling section
8, 9 Mould elements
10 Ejector

What is claimed is:

1. A method for producing cast items of a conductive material, comprising the following steps:

introducing a charge of the conductive material into a sphere of influence of at least one alternating electromagnetic field, so that the charge is kept in a levitating state, melting the charge, positioning a mould in a filling region below the levitating charge, pouring the entire charge into the mould and solidifying the charge into a cast item, removing the solidified cast item from the mould, wherein the volume of the molten charge is sufficient to fill the mould to a fill volume that is sufficient for the production of a cast item, and wherein at the moment of filling, the mould is moved in translation parallel to the direction of pouring of the charge.

2. The method according to claim 1, wherein the mould is removed from the filling region after pouring of the charge and prior to removal of the cast item.

3. The method according to claim 2, wherein another empty mould is moved into the filling region after the removal from the filling region of the mould filled with the charge, or entirely or partially simultaneously with the removal from the filling region of the mould filled with the charge.

4. The method according to claim 1, wherein the mould is preheated prior to filling.

5. The method according to claim 1, wherein the mould is rotated about a vertical axis during filling.

6. The method according to claim 5, wherein the rotation is carried out with a rotational speed of 10 to 1000 revolutions per minute.

7. The method according to claim 5, wherein the rotation is carried out with a rotational speed of 100 to 500 revolutions per minute.

8. The method according to claim 1, wherein both melting of the charge and filling of the mould are carried out under vacuum or under a protective gas or one of the noble gases or mixtures thereof.

9. The method according to claim 1, wherein, at the moment of filling, the mould is moved in translation in the direction of pouring of the charge.

10. The method according to claim 1, wherein a rotational and/or the translational movement is triggered by the pouring of the charge.

11. The method according to claim 1, wherein the conductive material comprises at least one metal from the following group: titanium, zirconium, vanadium, tantalum, tungsten, hafnium, niobium, rhenium, molybdenum, nickel, iron, or aluminium.

12. The method according to claim 11, wherein the at least one metal has a fraction of at least 50 wt. % of the conductive material.

13. The method according to claim 1, wherein the conductive material is titanium or a titanium alloy.

14. The method according to claim 1, wherein the conductive material is superheated, during melting, to a temperature at least 10° C. above the melting point of the material.

15. The method according to claim 1, wherein the casting mould is made of a metallic or ceramic material.

16. The method according to claim 15, wherein the casting mould is made of an oxide-ceramic material.

17. The method according to claim 1, wherein melting is carried out for a duration of 0.5 min to 20 min.

18. The method according to claim 1, wherein, in order to bring about the levitating state of the charge, use is made of at least two electromagnetic fields of different alternating current frequency.

19. The method according to claim 18, wherein, in the absence of a load, the at least two electromagnetic fields produced run horizontally.

20. The method according to claim 18, wherein, in the absence of a load, the at least two electromagnetic fields produced are arranged at right angles to one another.

21. The method according to claim 1, wherein, in order to concentrate the at least one electromagnetic field and stabilize the charge, at least one ferromagnetic element made of a ferromagnetic material having an amplitude permeability $\mu_a>10$, is arranged horizontally around the region in which the charge is melted.

22. The method according to claim 18, wherein the at least two electromagnetic fields are generated using at least two pairs of induction coils whose axes (A, B) are oriented horizontally.

23. The method according to claim 18, wherein in addition a coil having a vertical coil axis is arranged below the charge to be melted, in order to influence the pouring rate, wherein this coil generates an electromagnetic field of a third alternating current frequency.

24. The method according to claim 23, wherein the coil is a conical coil.

25. The method according to claim 1, wherein the mould is a permanent die having two or more mould elements, wherein the removal of the cast item from the permanent die involves the separation of the two or more mould elements.

* * * * *